United States Patent [19]

Howard

[11] 4,375,629

[45] Mar. 1, 1983

[54] FUSE WITH ALUMINUM FUSE ELEMENT HAVING TIN-PLATED COPPER TERMINALS

[75] Inventor: John F. Howard, Peterborough, Canada

[73] Assignee: Canadian General Electric Co., Ltd., Toronto, Canada

[21] Appl. No.: 277,544

[22] Filed: Jun. 26, 1981

[30] Foreign Application Priority Data

Oct. 16, 1980 [CA] Canada ..... 362558

[51] Int. Cl.[3] ..... H01H 85/10

[52] U.S. Cl. ..... 337/159; 337/295

[58] Field of Search ..... 29/623; 337/158-161, 337/206, 231, 252, 290, 293, 295

[56] References Cited

U.S. PATENT DOCUMENTS

| | | | |
|---|---|---|---|
| 3,509,608 | 5/1970 | Bennett | 29/482 |
| 3,523,264 | 8/1970 | Ieenan et al. | 337/295 |
| 3,566,008 | 2/1971 | Ettlinger | 174/94 |
| 3,640,556 | 2/1972 | Bennett | 287/189.36 B |
| 3,801,945 | 4/1974 | Howard | 337/290 |
| 4,010,438 | 3/1977 | Scherer | 337/232 |
| 4,150,354 | 4/1979 | Namitokov et al. | 337/290 |

FOREIGN PATENT DOCUMENTS

| | | | |
|---|---|---|---|
| 941444 | 2/1974 | Canada | 318/51 |
| 422762 | 1/1935 | United Kingdom | 337/290 |
| 51742 | 7/1969 | Romania | 337/295 |

*Primary Examiner*—William H. Beha, Jr.
*Attorney, Agent, or Firm*—William Freedman

[57] ABSTRACT

A fuse element is a ribbon of aluminum or aluminum alloy having a terminal at each end of the ribbon. Each terminal is made of copper sheet material having a portion that is tin plated. The tin plated portion is folded over the end of the ribbon to contact both sides and is welded to the ribbon to form a connection capable of carrying short circuit currents and able to withstand repeated temperature changes. Preferably the weld consists of three side-by-side spot welds extending on either side of the ribbon to the respective tin plated terminal portion.

4 Claims, 5 Drawing Figures

FUSE WITH ALUMINUM FUSE ELEMENT HAVING TIN-PLATED COPPER TERMINALS

BACKGROUND OF THE INVENTION

This invention relates to current limiting fuses, and in particular it relates to current limiting fuses having fusible elements of aluminum or aluminum alloys.

Current limiting fuses are well known in the art. One use for such a current limiting fuse is in a motor starter where the fuse is used in combination with an overload relay and/or a circuit breaker. The fuse limits large fault currents so that the overload relay is not damaged. Canadian Pat. No. 941,444-KRUZIC, issued Feb. 5, 1974, describes such a combination of current limiting fuse and overload relay. Another use for a current limiting fuse is to protect capacitors in a capacitor bank used, for example, to provide phase angle correction in an electrical system. The capacitors in a bank used for phase angle correction are usually in a series/parallel arrangement to provide the required correction at the necessary voltage. If a capacitor fails, all the capacitors in parallel with it will tend to discharge through the failed capacitor and this could involve a considerable amount of electrical energy. Each capacitor is therefore protected with a current limiting fuse.

A high voltage, current limiting fuse usually has a cylindrical casing of insulating material with a terminal cap or end cap of conducting metal closing each end. At least one fusible element or fuse element is connected between the end caps and the casing is filled with an arc-quenching material such as quartz sand to assist in extinguishing arcs which form along the fuse elements when it is subjected to fault currents. The fuse elements have areas of reduced cross-sectional areas at intervals along the length of the ribbon-like fuse elements to encourage arc formation and limit the fault current.

A current limiting fuse used in a motor starting circuit may have between perhaps 2 and 24 fuse elements extending in an uncoiled arrangement between end caps for a motor operating up to, for example, 5 kV (kilovolts). A high voltage, current limiting fuse for use in a capacitor bank may have, for example, a single helically coiled fuse element of perhaps 5 ft. to 8 ft. in length extending between the end caps. The fuse elements in the past have, with few exceptions, been of silver ribbon. It will be seen that fuses of these types use a considerable amount of silver. Silver is an expensive material and it is not always readily available. Many attempts have been made to use a less expensive material for a fuse element and to use a more readily available material. U.S. Pat. No. 4,150,354—NAMITOKOV et al, issued Apr. 17, 1979 describes a current limiting fuse with a fuse link of aluminum or aluminum alloy. Aluminum is a cheaper material than silver, it is more widely available, and it has reasonably good conductivity. These qualities make aluminum a reasonable alternative to silver. In this aforementioned United States patent the terminal contacts or end caps are of aluminum to prevent electrochemical corrosion where they connect to the fuse link and the disclosure indicates tested fuses have been operated at 660 V.

It is not always convenient or desirable to make the end caps of a cartridge fuse of aluminum in order to avoid joining aluminum with a different metal. However, it is difficult to join an aluminum fuse element to another material, such as copper for example, to make a reliable joint that will withstand repeated temperature cycling.

One object of the present invention is to provide a novel high voltage, current limiting fuse, having an aluminum fuse element joined to a copper terminal where the terminal is joined to the end cap.

It is another object of the invention to provide in a current limiting fuse, an aluminum fuse element having a novel arrangement of areas of reduced cross-section suitable for encouraging arc formation with overload currents.

These and other objects of the present invention will become apparent to those skilled in the art upon consideration of the following description of the invention.

SUMMARY OF THE INVENTION

In accordance with one preferred embodiment of the present invention there is provided a fuse element for a current limiting fuse, comprising a ribbon of aluminum or aluminum alloy and a terminal of copper sheet material having at least a portion thereof tin plated said portion contacting a surface at an end of said ribbon and being welded to an end of said ribbon.

In accordance with another embodiment of the present invention there is provided a high voltage, current limiting fuse comprising a tubular casing of insulating material, end caps of plated copper on each end of said casing, closing said casing, at least one fusible ribbon of aluminum or aluminum alloy within said casing and having an end adjacent a respective end cap, a terminal at each end of each said ribbon, each said terminal being of copper sheet at least a portion thereof tin plated, said tin plated portion being bent over a respective end of said ribbon and being welded thereto, said terminal being connected to a respective end cap, and a pulverulent arc quenching material surrounding said ribbon and filling said casing.

The features of the invention believed to be novel are set forth with particularity in the appended claims. The invention, itself, however, both as to its organization and operation, together with further objects and advantages thereof, may best be understood by reference to the following description taken in conjunction with the accompanying drawings.

DETAILED DESCRIPTION OF PREFERRED EMBODIMENTS

Figure 1:
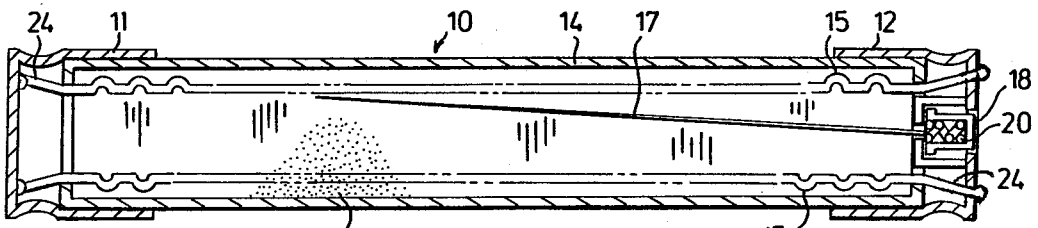
FIG. 1 is a sectional side view of a current limiting fuse.

Referring to FIG. 1, there is shown a cartridge fuse 10 of a type referred to as a high voltage, current limiting fuse. It has metal end closures or end caps 11 and 12 made, for example, of plated copper, and an insulating cylindrical casing 14. A plurality of fuse elements 15 extend between end caps 11 and 12. The casing is filled with an arc quenching material 16 such as quartz sand. In fuse 10 there is an indicator wire 17 which is fastened (not shown) at its mid-point to end cap 11 and both sides extend back to an indicator button 18 in a recess formed in end cap 12. The indicator button 18 is biased outwardly by spring 20 and is restrained from outward movement by indicator wire 17. When the fuse blows, that is when ruptures develop along one or more of fuse elements 15 and arcs are created, the indicator wire 17 is caused to rupture and release the indicator button 18 to provide a visual indication of a blown fuse.

Figure 2:
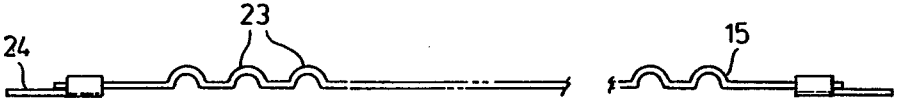
FIG. 2 is a side view of an aluminum fuse element according to the invention.
Figure 3:
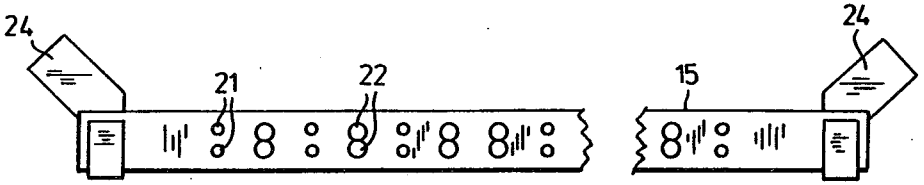
FIG. 3 is a plan view of a fuse element before it has been formed to provide the indentations seen in FIG. 2.

FIGS. 2 and 3 show an elevation and a plan view, respectively, of a fuse element 15. The fuse element 15 has a plurality of holes 21 and 22, shown in FIG. 3, punched in it to provide places at which arcs may form when a short circuit current flows. As is known, it is desirable to encourage multiple arcs for current limiting. It has been found that patterns of pairs of smaller holes 21 and pairs of larger holes 22, as shown, are very suitable. These patterns cause a current flow path which on either side of fuse element 15 has a generally serpentine configuration in as much as adjacent the larger holes 22 the path of the net current is near the edges of the fuse element 15 whereas as near the small holes 21 the path of the net current is closer to the center line of the fuse element 15. While the larger holes 22 may be alternated with the smaller holes 21, at intervals there may be two pairs of larger holes 22 adjacent one another. This is to make the current path more irregular and to encourage the formation of unstable arcs with short circuit currents. Each pair of larger holes have edges which are closely adjacent at the centerline or which touch.

The fuse element 15 additionally is formed with a series of humps or indented portions or loops 23 spaced along the length of the element. This is best seen in FIG. 2. The loops 23 provide a spring force keeping the fuse element 15 in position, particularly during assembly when the arc quenching material 16 is being introduced into the fuse, as well as enabling a slightly greater length of fuse element to be used.

Figure 4:
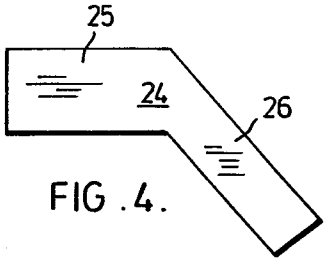
FIG. 4 is a plan view of a terminal for an aluminum fuse element.

The fuse element 15 has a terminal 24 at each end. The terminal 24 is best seen in FIGS. 2, 3, 4 and 5. The terminal 24 is shown in FIG. 4 in its unformed state and is preferably of copper sheet material. The terminal 24 has a larger end 25 and a smaller end 26 as shown. The smaller end 26 is tin plated to aid in forming a satisfactory bond to the aluminum fuse element. The larger end 25 is intended to be welded to the respective end cap.

Figure 5:
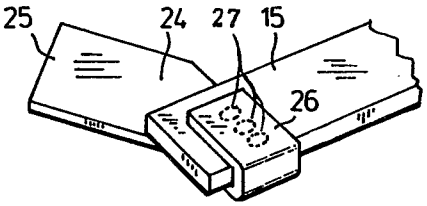
FIG. 5 is an isometric view showing a portion of a fuse element with the terminal attached.

FIG. 5 shows the terminal 24 secured to an end of fuse element 15. This is done by forming the smaller end 26 of terminal 24 over the end of fuse element 15 so that the tin plated surface of end 26 is pressed against the surface of the aluminum fuse element 15, and at least one weld is made as indicated at 27. Preferably two or three spot welds 27 are made. The welds must be satisfactory to keep the temperature as low as possible in the terminal area when large currents flow. Any rupturing or arcing, when a short circuit current flows, should take place on the fuse element but not in the region of terminal 24.

It will, of course, be apparent that the particular configuration of terminal 24 is not significant. It is preferred that the terminal 24 be bent over the fuse element so that welds 27 are provided on both sides, and it is preferred that multiple welds 27 are used. The direction at which the terminal 24 extends is selected for convenience assembly or handling.

While a type of current limiting fuse normally used in motor circuits has been shown and described, the same terminals 24 can, of course, be affixed to the ends of a coiled aluminum fuse element such as is used in a high voltage current limiting fuse of the type used in a capacitor bank. The terminals 24 are affixed in the same manner as has been previously described.

While the invention has been particularly shown and described with reference to several preferred embodiments thereof, it will be understood by those skilled in the art that various changes in form and detail may be made therein without departing from the spirit and scope of the invention as defined by the appended claims.

What is claimed is:

1. A fuse element for a current limiting fuse, comprising:

a ribbon of aluminum or aluminum alloy, and a terminal at each end of said ribbon of copper sheet material having at least a portion thereof tin plated, said portion being bent over a respective end of said ribbon with the tin plated surface thereof contacting both sides of said respective end and being welded to said end, said portion of each said terminal being welded to said respective end by at least one spot weld forming a welded portion between said respective end and the respective portion on either side of said end, said ribbon having spaced along the length thereof a plurality of pairs of larger and smaller holes, each of said pairs of larger holes being defined by edges which are closely adjacent at the centerline of said ribbon, the pairs of smaller and larger holes alternating along the length of the ribbon.

2. A fuse element as defined in claim 1 in which said terminal at each end of said ribbon has tin plating on both sides of said portion thereof.

3. A fuse element for a current limiting fuse, comprising:

a ribbon of aluminum or aluminum alloy, and a terminal at each end of said ribbon of copper sheet material having at least a portion thereof tin plated, said portion being bent over a respective end of said ribbon with the tin plated surface thereof contacting both sides of said respective end and being welded to said end, said portion of each said terminal being welded to said respective end by at least one spot weld forming a welded portion between said respective end and the respective portion on either side of said end, said ribbon having spaced along the length thereof a plurality of pairs of larger and smaller holes, each of said pairs of larger holes being defined by edges which are closely adjacent at the centerline of said ribbon, pairs of smaller and larger holes alternating in some regions of the ribbon and other regions having a pair of smaller holes alternating with two spaced apart pairs of larger holes.

4. A fuse element as defined in claim 3 in which said terminal at each end of said ribbon has tin plating on both sides of said portion thereof.

* * * * *